US009770819B2

(12) United States Patent
Lam et al.

(10) Patent No.: US 9,770,819 B2
(45) Date of Patent: Sep. 26, 2017

(54) PNEUMATICALLY ACTUATED MECHANICAL HAND TOOL

(71) Applicant: Stanley Fastening Systems, L.P., North Kingstown, RI (US)

(72) Inventors: Lok C. Lam, Warwick, RI (US); Brian C. Burke, Barrington, RI (US)

(73) Assignee: Stanley Fastening Systems, L.P., North Kingstown, RI (US)

( * ) Notice: Subject to any disclaimer, the term of this patent is extended or adjusted under 35 U.S.C. 154(b) by 720 days.

(21) Appl. No.: 13/834,935

(22) Filed: Mar. 15, 2013

(65) Prior Publication Data

US 2013/0334275 A1 Dec. 19, 2013

Related U.S. Application Data

(60) Provisional application No. 61/659,819, filed on Jun. 14, 2012.

(51) Int. Cl.
*B25C 1/04* (2006.01)
*B25C 5/13* (2006.01)

(52) U.S. Cl.
CPC ..... *B25C 1/047* (2013.01); *B25C 5/13* (2013.01)

(58) Field of Classification Search
CPC B25C 1/06; B25C 1/008; B25C 1/184; B25C 1/00; B25C 1/04; B25F 5/02; B25D 17/00
USPC ..... 227/8, 130, 156; 173/170–171
See application file for complete search history.

(56) References Cited

U.S. PATENT DOCUMENTS

| | | | | |
|---|---|---|---|---|
| 2,294,463 | A | 9/1942 | Krantz | |
| 2,558,403 | A | 6/1951 | Wandel | |
| 2,625,682 | A | 1/1953 | Cristiano | |
| 2,775,765 | A | 1/1957 | Klopstock | |
| 2,792,571 | A | 5/1957 | Klopstock | |
| 3,480,193 | A | 11/1969 | Ralston | |
| 4,606,487 | A * | 8/1986 | Douri | B30B 1/106 227/115 |
| 5,335,839 | A | 8/1994 | Fealey | |
| 5,366,132 | A * | 11/1994 | Simonelli | B25C 1/008 227/130 |
| 5,522,532 | A * | 6/1996 | Chen | B25C 1/04 227/130 |

(Continued)

FOREIGN PATENT DOCUMENTS

| | | |
|---|---|---|
| DE | 963415 C | 5/1957 |
| GB | 2025562 A | 1/1980 |

OTHER PUBLICATIONS

Carmichael, Guy—Extended European Search Report—dated Aug. 29, 2013—8 pages—The Hague.

*Primary Examiner* — Hemant M Desai
*Assistant Examiner* — Valentin Neacsu
(74) *Attorney, Agent, or Firm* — Rhoda L. Barton

(57) ABSTRACT

A hand tool for mechanically generating and delivering a driving force to a fastener. The hand tool includes a mechanical force delivery system that is structured and operable to mechanically generate and deliver a driving force to a fastener. The hand tool additionally includes a pneumatic actuation device that is operatively connected to the mechanical force delivery system. The pneumatic actuation device is structured and operable to actuate the mechanical force delivery system such that the mechanical force delivery system mechanically generates and delivers the driving force.

12 Claims, 8 Drawing Sheets

(56) References Cited

U.S. PATENT DOCUMENTS 5,551,620 A * 9/1996 Vallee ..... B25C 1/043 227/120
5,687,897 A * 11/1997 Fa ..... B25C 1/046 227/8
6,116,488 A * 9/2000 Lee ..... B25C 1/008 227/130
7,143,918 B2 * 12/2006 Aguirre ..... B25C 1/008 227/130
7,152,773 B2 * 12/2006 Ke ..... B25C 1/043 227/130
7,308,995 B2 * 12/2007 Uchiyama ..... B25C 1/043 227/130
7,322,426 B2 * 1/2008 Aguirre ..... B25C 1/008 173/1
7,395,955 B2 7/2008 Zins et al.
7,540,400 B2 6/2009 Zins et al.
7,810,688 B2 * 10/2010 Wu ..... B25C 1/008 227/120
2004/0164120 A1 * 8/2004 Boswinkel ..... B25C 5/0257 227/132
2005/0023318 A1 * 2/2005 Aguirre ..... B25C 1/008 227/8
2006/0108388 A1 * 5/2006 Liu ..... B25C 1/008 227/10
2006/0261121 A1 * 11/2006 Uchiyama ..... B25C 1/043 227/8
2008/0156844 A1 * 7/2008 Braganza ..... B25C 5/1658 227/109
2008/0264996 A1 * 10/2008 Chang ..... B25C 1/043 227/8
2009/0108046 A1 * 4/2009 Huang ..... B25C 1/008 227/8
2010/0012700 A1 * 1/2010 Perron ..... B25C 1/008 227/8
2010/0116863 A1 * 5/2010 Suda ..... B25C 1/06 227/8
2010/0140314 A1 * 6/2010 Tillinghast ..... B25C 1/043 227/8
2011/0248061 A1 * 10/2011 Liu ..... B25F 5/00 227/8

* cited by examiner

PNEUMATICALLY ACTUATED MECHANICAL HAND TOOL

CROSS-REFERENCE TO RELATED APPLICATIONS

This application claims the benefit of priority of U.S. Provisional Patent Application No. 61/659,819, filed Jun. 14, 2012. The disclosure of the above application is incorporated herein by reference in its entirety.

FIELD

The present teachings relate to pneumatically actuated hand tools, and, more particularly, to hand tools that have the general structure of a manually actuated hand tool and include a pneumatic actuator that is structured and operable to actuate a mechanical force generation and delivery mechanism of the respective tool.

BACKGROUND

The statements in this section merely provide background information related to the present disclosure and may not constitute prior art.

Known manually actuated hand tools require the operator to expend considerable manual energy when using the respective hand tool repetitiously over a long period of time. For example, many known hand tools can require 15-20 lbs of hand-squeezing force for each actuation. Hence, if the operator is required to repeatedly actuate the respective hand tool many times over a long period of time, considerable operator fatigue can occur.

For example, one such exemplary hand tool is a manually actuated tacking tool. A tacking tool is a tool that can be used for fastening wrapping material, roofing tar paper or other applications including but not limited to the installation of ceiling tiles, insulation, crafts, decorative lights and, flyers. Most known manually actuated tacking tools typically require 15-20 lbs of hand-squeezing force to actuate the mechanical force generation and delivery mechanism within the tool to drive a single fastener. As such, in applications where such manually-actuated tacking tools are used, over time, the repetitious manual actuation can cause considerable operator fatigue.

Typical pneumatically operated tools that pneumatically generate and deliver a fastener driving force are complex, and thus expensive. For example, a typical pneumatic hand tool generally requires an expensive die cast housing that functions as an air pressure vessel and two signal valves, e.g., a head valve and a trigger valve, to control the air pressure within the pressure vessel that is utilized to generate and deliver the fastener driver force. Such fabrication, components and structure are complex and expensive.

SUMMARY

The present disclosure provides a hand tool for mechanically generating and delivering a driving force to a fastener. In various embodiments, the hand tool comprises a mechanical force delivery system that is structured and operable to mechanically generate and deliver a driving force to a fastener. In such embodiments, the tool additionally comprises a pneumatic actuation device that operatively connected to the mechanical force delivery system. The pneumatic actuation device is structured and operable to actuate the mechanical force delivery system such that the mechanical force delivery system mechanically generates and delivers the driving force.

Further areas of applicability will become apparent from the description provided herein. It should be understood that the description and specific examples in this summary are intended for purposes of illustration only and are not intended to limit the scope of the present disclosure, its application and/or uses in any way.

BRIEF DESCRIPTION OF THE DRAWINGS

The drawings described herein are for illustration purposes only and are not intended to limit the scope of the present teachings in any way.

DETAILED DESCRIPTION

Figure 1:
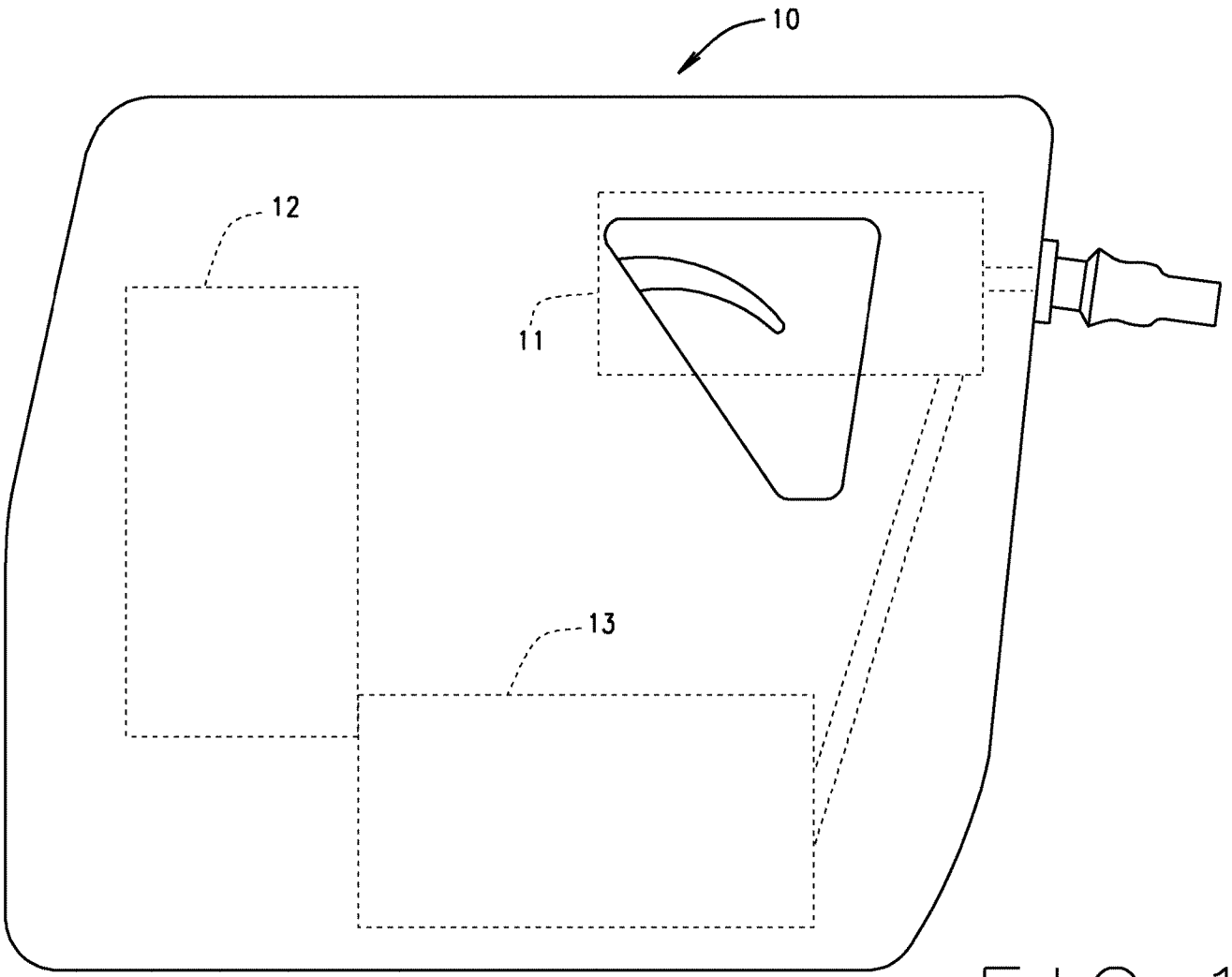
FIG. 1 is a block diagram of hand tool structured and operable to utilize a pneumatic actuation device to actuate a mechanical force delivery system, in accordance with various embodiments of the present disclosure.

The following description is merely exemplary in nature and is in no way intended to limit the present teachings, application, or uses. Throughout this specification, like reference numerals will be used to refer to like elements.

FIG. 1 exemplarily illustrates a pneumatically actuated hand tool 10 that is structured and operable to mechanically generate and deliver a mechanical driving force to fasteners that are dispensibly loaded in the hand tool 10. Generally, the hand tool 10 includes a mechanical force generation and delivery system 12, a pneumatic actuation device 13 operatively connected to the mechanical force generation and delivery system 12, and a double-pull safety trigger assembly 11 fluidly connected to the pneumatic actuation device 13. The mechanical force generation and delivery system 12 is structured and operable to mechanically generate and deliver the mechanical driving force to fasteners loaded in the tool. The double-pull safety trigger assembly 11 is structured and operable to control a flow of forced or compressed air, provided by an external forced air source (not shown), to the pneumatic actuation device 13. And, the pneumatic actuation device 13 is structured and operable to receive the forced air from the external forced air source, as controlled by the double-pull safety trigger assembly 11, and utilize the received forced air to actuate the mechanical force generation and delivery system 12 such that the mechanical force generation and delivery system 12 mechanically generates and delivers the mechanical driving force to the fasteners, whereby the fasteners are dispensed, or driven, from the tool 10.

The hand tool 10 can be any hand held fastener delivery tool, such as a tacking tool, a finish nailer, a brad stapler, etc. While the embodiments disclosed herein will be exemplarily described with reference to a tacking tool, the teachings of the present disclosure can be applied with equal advantage to any other hand tool, e.g., finish nailers, brad staplers, etc., without departing from the scope of the present disclosure.

Referring to FIGS. 2-5, as described above the hand tool 10, e.g., the tacking tool 10, generally comprises the mechanical force generation and delivery system 12 operatively connected to the pneumatic actuation device 13 and the double-pull safety trigger assembly 11 fluidly connected to the pneumatic actuation device 13. The mechanical force generation and delivery system 12, the pneumatic actuation device 13 and the double-pull safety trigger assembly 11 are generally disposed within a tool housing 14 of the tool 10.

In various embodiments, the mechanical force generation and delivery system 12 includes a spring lifter assembly 22, at least one leaf spring 26, a fork connector 30, and a driver blade 42, disposed within the tool housing 14. The driver blade 42 is fixedly connected to a distal end 44 of the leaf spring(s) 26. Additionally, in such embodiments, the pneumatic actuation device 13 includes a body 18, a piston 82 slidably disposed within the body 18, and an air inlet 68 formed in a proximal end of the body 18 and fluidly connectable to the forced air source. The piston 82 is operatively connected to the mechanical force generation and delivery system 12 via a piston rod 86 extending orthogonally from the piston. Particularly, the piston rod 86 is operatively connected to the mechanical force generation and delivery system 12 such that forced air controllably flowing into the body 18 from the forced air source forces the piston 82 from a Home position (shown in FIGS. 2 and 3) to an Actuated position (shown in FIGS. 4 and 5) to actuate the mechanical force generation and delivery system 12. Upon actuation by the pneumatic actuation device 13, the mechanical force delivery system 13 mechanically generates and delivers the mechanical driving force. Furthermore, in such embodiments the double-pull safety trigger assembly 11 comprises a trigger mechanism 34, an air supply connector fitting 46, e.g., a quick connect fitting, an air supply line 50, and charge supply line 54. The fitting 46 connects the tool 10 to the outside source of forced or compressed air and the air supply line 50 is fluidly connected at a proximal end 58 to fitting 46. A distal end 62 of the air supply line 50 fluidly connects the outside source of forced or compressed air to the trigger mechanism 34. The charge supply line 54 is fluidly connected at a proximal end 66 to the trigger mechanism 34 and to the pneumatic actuation device 13 at a distal end 70.

As shown in the various embodiments of FIGS. 2-5, the pneumatic actuation device 13 comprises an air cylinder including the body 18, the piston 82 slidably disposed within the body 18 having the piston rod 86 extending therefrom. Particularly, the piston rod 86 extends longitudinally through the body 18 and exits the body 18 at a distal end thereof. The pneumatic actuation device 13 is pivotally mounted at a proximal end 74 within the tool housing 14 by actuator pivot pin 78 such that the pneumatic actuation device 13 can rotate freely about the actuator pivot pin 78. A proximal end 94 of the fork connector 30 is rotatably mounted to a distal end 90 of the piston rod 86 by connecting pin 98. Additionally, a distal end 102 of the fork connector 30 is fixedly connected to the spring lifter assembly 22.

In various embodiments, the spring lifter assembly 22 includes a lifter housing 108, a spring lifter pawl 110, a fork pivot pin 114, a swing fork 118, and a lifter pivot 122. The swing fork 118 includes engagement arms 126 which are structured and operable to slidably engage the lifter pivot 122. The spring lifter pawl 110, the swing fork 118, and the lifter pivot 122 are generally disposed within the lifter housing 108. The spring lifter assembly 22 further includes a return spring 134. A first end of the return spring 134 engages the lifter housing 108 and an opposing end of the return spring 134 engages a stop block 146 disposed within housing 14. The swing fork 118 is rotatably mounted within the tool housing 14, via the fork pivot pin 114, and includes a lifter stop pin 148.

The spring lifter pawl 110 includes at least one finger 150 having a catch tooth 154 formed at a distal end thereof. Each catch tooth 154 is structured and operable to engage the distal end 44 of the leaf spring(s) 26 in order to pull or lift the leaf spring distal end(s) 44 in an A+ direction to mechanically generate the mechanical driving force, as described further below. The spring lifter pawl 110 further includes at least one tail 162 structured and operable to engage the lifter stop pin 148 of the swing fork 118, thereby assisting in the pulling or lifting of the leaf spring distal end(s) 44. The spring lifter assembly 22 is slidably mounted within the housing 14 via slide channels 166 formed within tool housing 14 and are structured and operable to control the travel of the spring lifter pawl 110 in the A+ and A− directions, as described herein. The leaf spring(s) 26 is/are fixedly mounted at a proximal end 170 within the housing 14 such that the leaf spring(s) 26 is/are engaged with a fulcrum 174 disposed within the housing 14. As described further below, as the spring lifter pawl 110 pulls/lifts the leaf spring distal end(s) 44, the leaf spring(s) 26 are forced to bend at the fulcrum 174, thereby mechanically generating the mechanical driving force.

Figure 2:
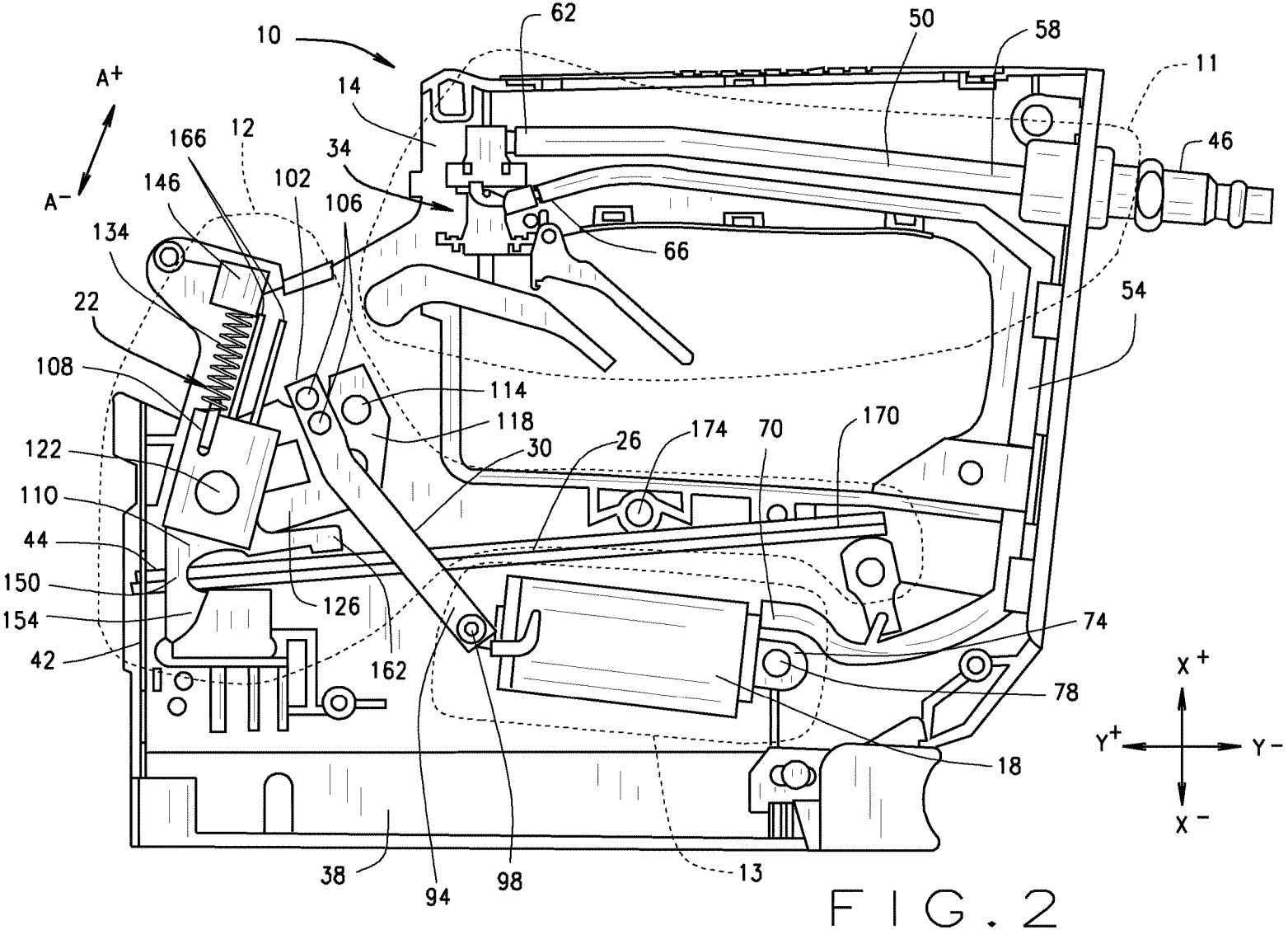
FIG. 2 illustrates the hand tool shown in FIG. 1, wherein the hand tool is exemplarily illustrated as a tacking tool, in accordance with various embodiments of the present disclosure.
Figure 7:
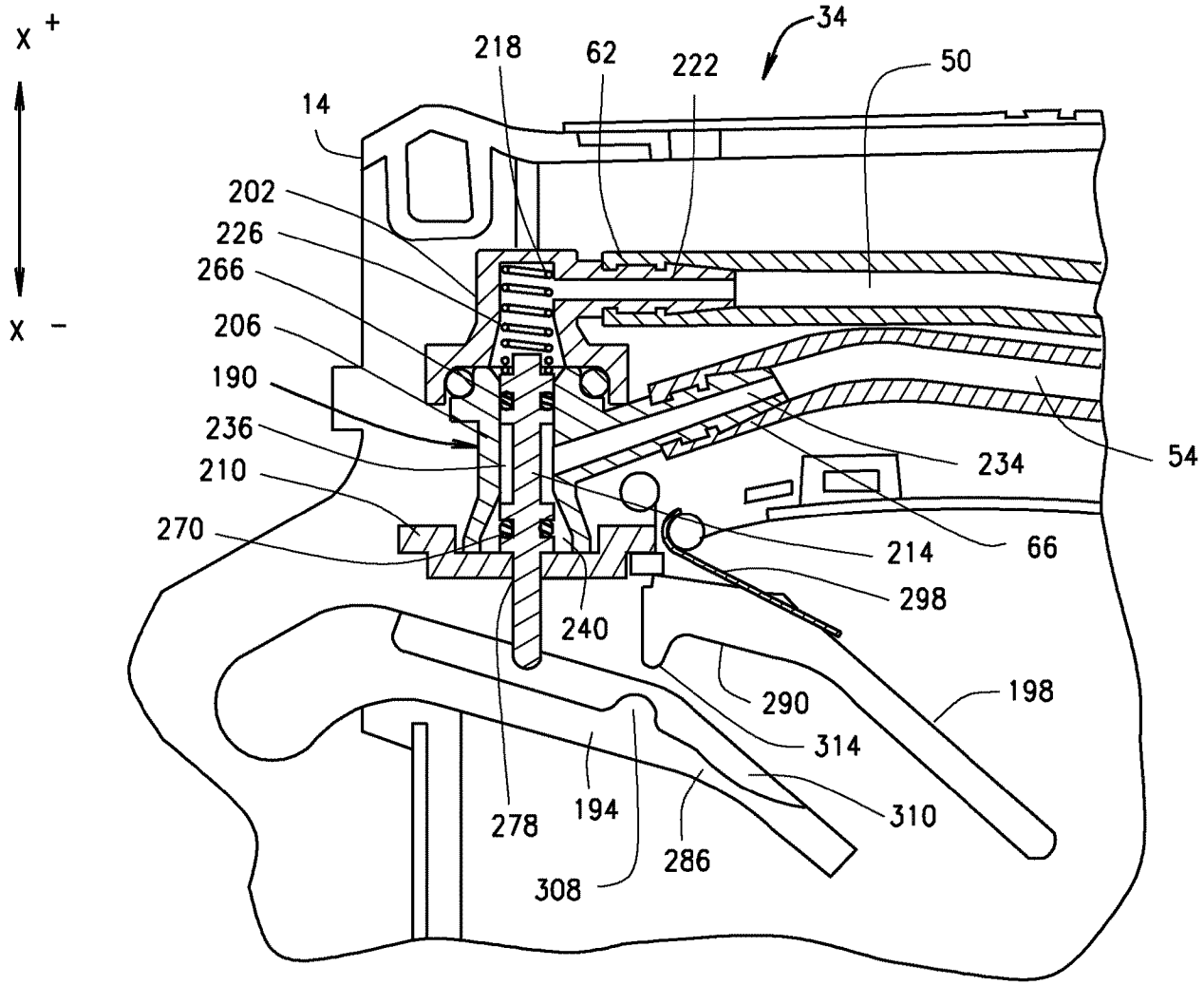
FIG. 7 is an enlarged view of a double-pull safety trigger assembly of the hand tool shown in FIG. 1, showing a trigger valve at a home position, in accordance with various embodiments of the present disclosure.
Figure 8:
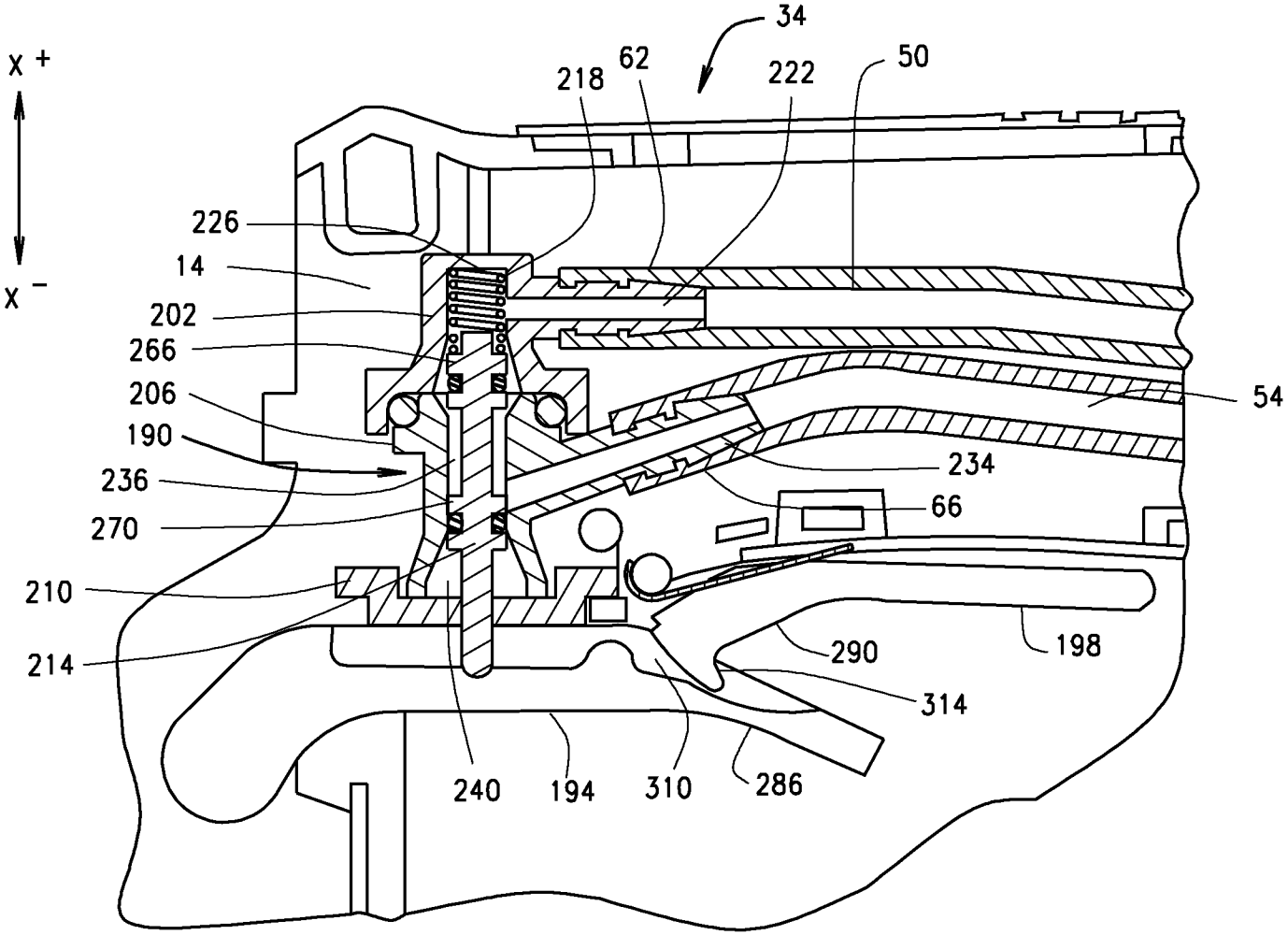
FIG. 8 is an enlarged view of the double-pull safety trigger assembly shown in FIG. 7, showing the trigger assembly at an actuated position, in accordance with various embodiments of the present disclosure.

Referring now to FIGS. 2, 7 and 8, in various embodiments, the trigger assembly 34 generally includes a trigger valve 190, a primary trigger 194 and a secondary trigger 198. In various implementations, the trigger valve 190 can be a simple on-off type air valve including a trigger valve cap 202, a trigger valve housing 206, a trigger valve plate 210, a trigger valve stem 214, and a trigger valve spring 218. The trigger valve cap 202 is connected to a top of the trigger valve housing 206 and includes a supply line fitting 222 structured and operable to create a sealed connection of the distal end 62 of the air supply line 50 with the trigger valve cap 202. The trigger valve cap 202 further includes an internal cavity 226 that is fluidly connected with a center bore 236 of the valve housing 206. The trigger valve housing 206 includes a charge line fitting 234 structured and operable to create a sealed connection of the proximal end 66 of the charge supply line 54 with the trigger valve housing 206. The center bore 236 is formed to have a fluted distal end 240 having a diameter that is greater than the diameter of the center bore 236. The trigger valve cap 202 and the trigger valve housing 206 are disposed within the tool housing 14 such that the fluted end 240 of the trigger valve housing 206 is in direct contact with the trigger valve plate 210. The trigger valve plate 210 contains a hole 278 having a diameter slightly greater than the diameter of the trigger valve stem 214.

The trigger valve stem 214 is slidably disposed within the valve housing center bore 236 and is formed to include a pair of annular channels that are structured and operable to retain an upper O-ring 266 and a lower O-ring 270. An upper end of the trigger valve stem 214 is sized and shaped to receive a lower end of the valve spring 218 and an opposing lower end of the valve stem 214 protrudes through a hole 278 formed in the valve plate 210 such that the valve stem lower end is engageable with the primary trigger 194. The valve spring 218 is disposed within the cap internal cavity 226 such that the valve spring 218 is retained in engagement with the upper end of the valve stem 214. The hole 278 is structured and operable to provide a guide for the motion of the trigger valve stem 214 in the $X^+$ and $X^-$ directions within the valve housing center bore 236. The upper O-ring 266 and lower O-ring 270 are each structured and operable to selectably provide, depending on a position of the valve stem 214 within the center bore 236, a substantially air-tight seal between the valve stem 214 and an interior wall of the valve housing defined by the center bore 236.

The primary trigger 194 is pivotally mounted within the tool housing 14 such that a distal end portion 286 extends past a proximal end portion 290 of the secondary trigger 198. Additionally, the secondary trigger 198 is pivotally mounted within, or to, the tool housing 14 and is biased away from the tool housing 14 via a biasing member 298. The primary trigger 194 is formed to include a stop bump 308 and recess 310, and the secondary trigger 198 is formed to include a protuberance 314. When the secondary trigger 198 is in a non-depressed position (shown in FIG. 7) the protuberance 314 aligns with the stop bump 308 such that any attempt to depress the primary trigger 194 without first depressing the secondary trigger 198 will cause the stop bump 308 to contact the protuberance 314 such that depression of the primary trigger 194 is prevented. Thus, the protuberance 314 is cooperative with the stop bump 308 such that the primary trigger 194 is prevented from being depressed to move the valve stem 214 in the X+ direction, unless the secondary trigger 198 is depressed prior to depressing the primary trigger 194.

However, if the secondary trigger 198 is depressed prior to depression of the primary trigger 194, the protuberance 314 of the secondary trigger 198 is aligned with the recess 310 of the primary trigger 194 such that the primary trigger 194 can be depressed. As described further below, when the primary trigger 194 is depressed the valve stem 214 is moved in the X+ direction allowing forced or compressed air from the forced air source to flow into the pneumatic actuation device 13, whereby the pneumatic actuation device operates the mechanical force generation and delivery system 12 such that the mechanical force generation and delivery system 12 mechanically generates and delivers the mechanical driving force.

Figure 3:
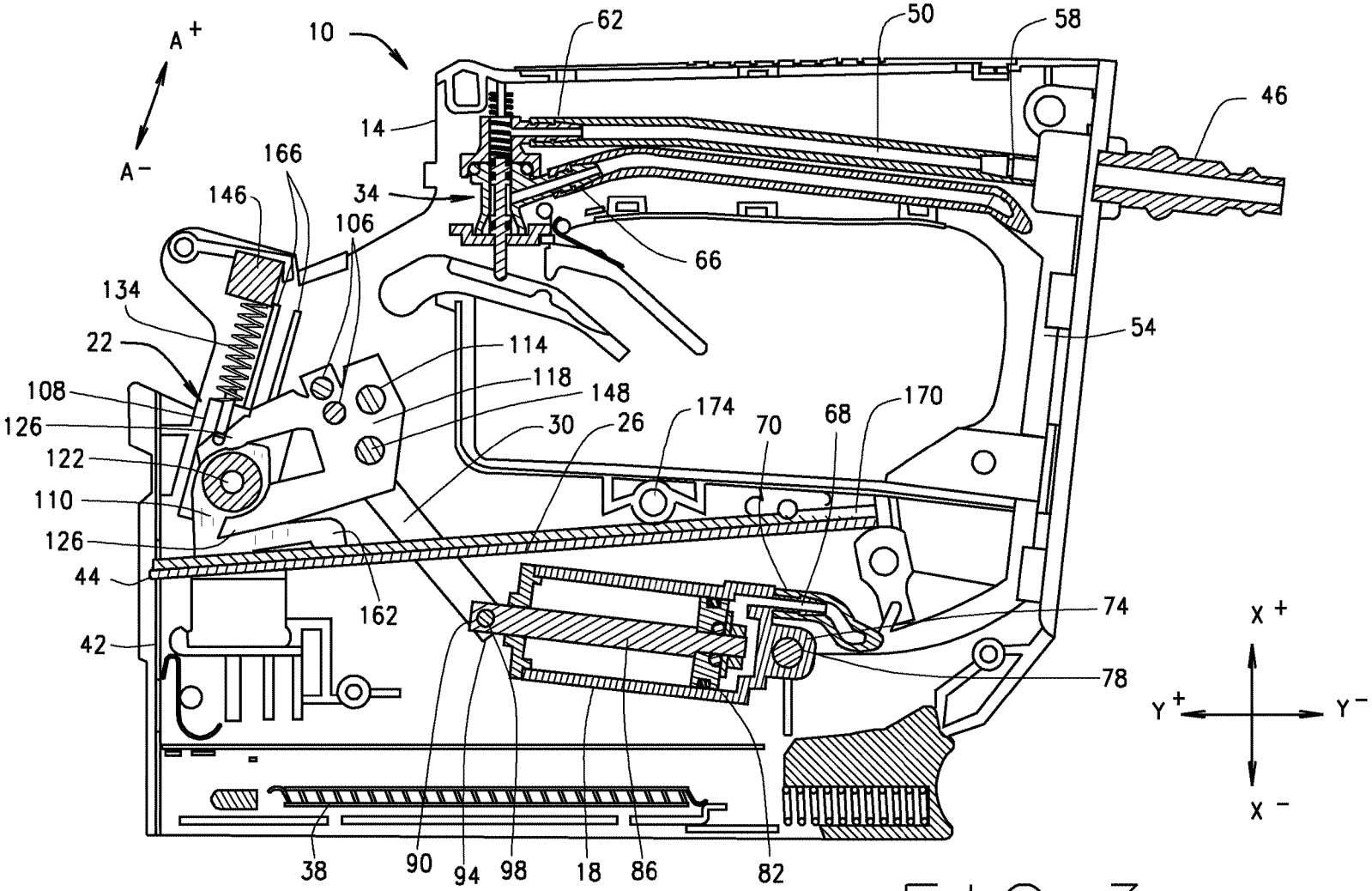
FIG. 3 illustrates a cross-sectional view of the hand tool exemplarily shown in FIG. 2, in accordance with various embodiments of the present disclosure.
Figure 4:
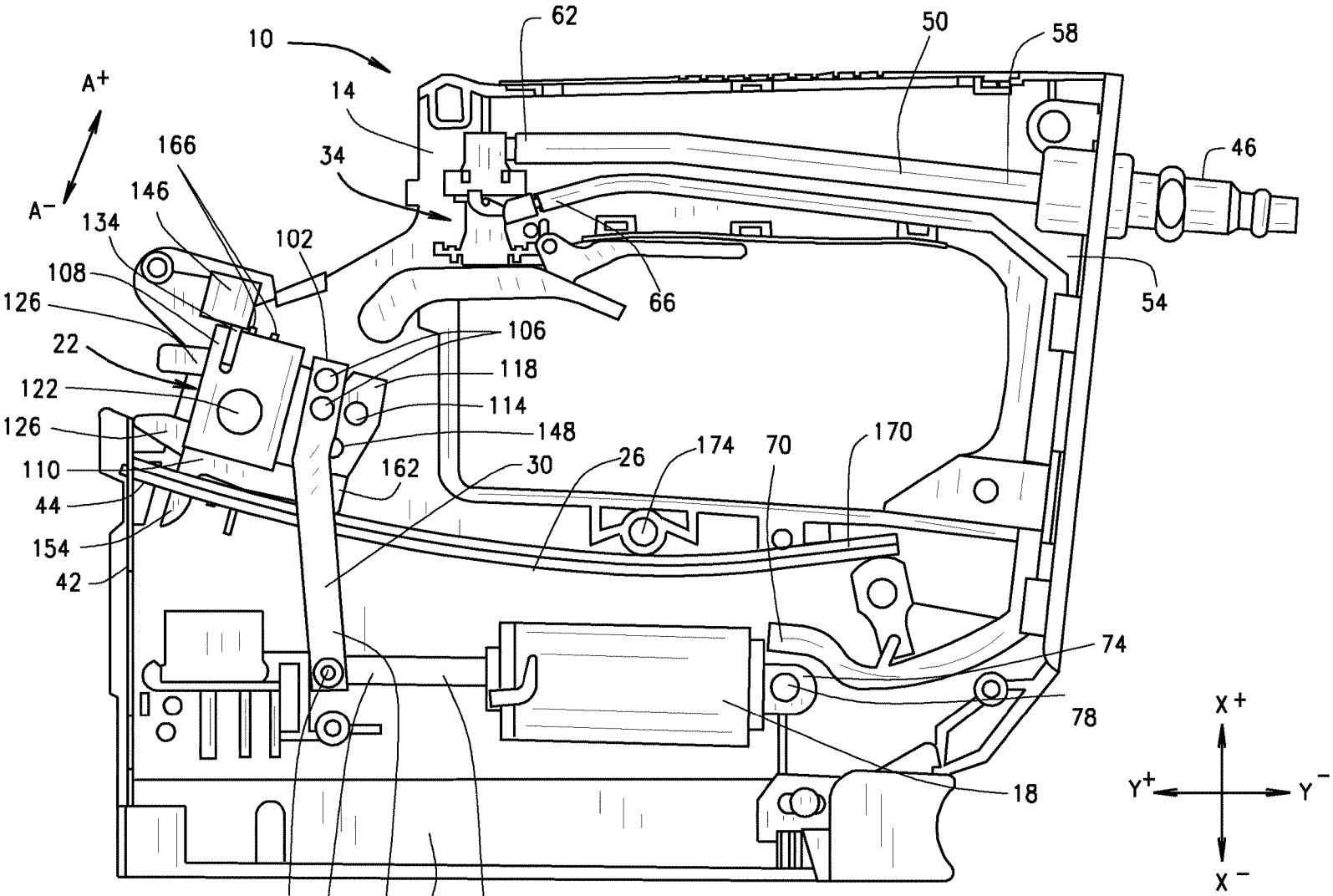
FIG. 4 illustrates the hand tool exemplarily shown in FIG. 2, having the pneumatic actuation device in an actuated position, in accordance with various embodiments of the present disclosure.
Figure 5:
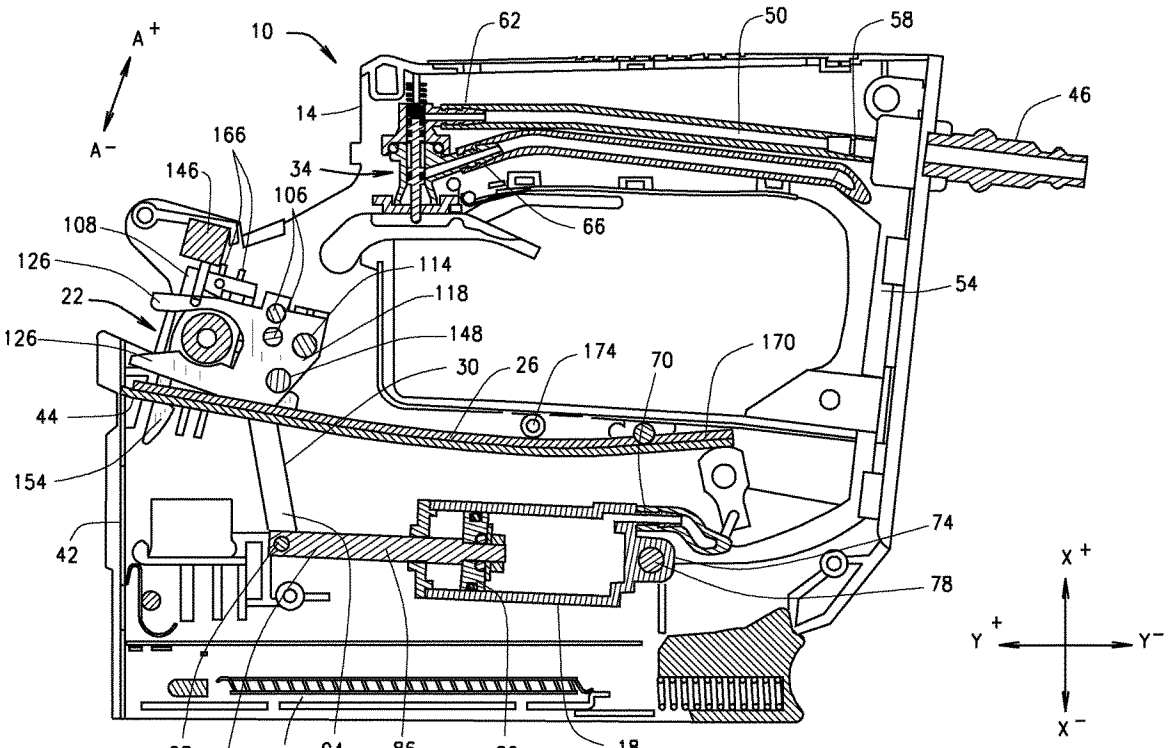
FIG. 5 illustrates a cross-sectional view of the hand tool exemplarily shown in FIG. 4, in accordance with various embodiments of the present disclosure.
Figure 6:
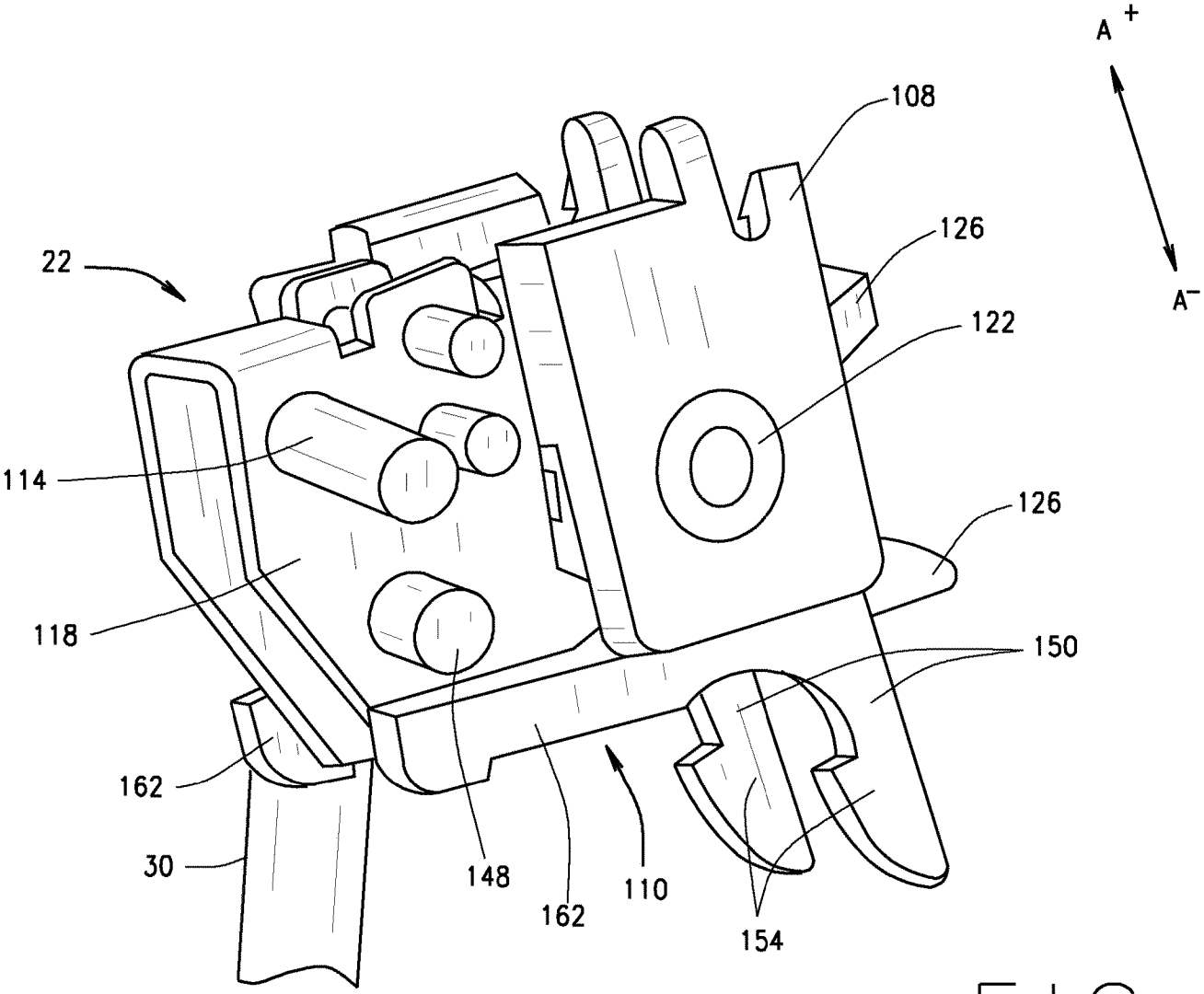
FIG. 6 is an enlarged view of a lifter assembly of the hand tool exemplarily shown in FIGS. 2-5, in accordance with various embodiments of the present disclosure.

FIGS. 2 and 3 show the tool 10 in a Non-Activated position, wherein the primary and secondary triggers 194 and 198 are not depressed, the piston 82 is positioned at the Home position within the actuation device body 18, the mechanical force generation and delivery system 12 is in a Neutral position, and the leaf spring(s) 26 are in a Non-Energized state. When tool 10 is in the Non-activated position, the trigger valve stem 214 is in the position shown in FIG. 7, wherein the upper O-ring 266 blocks the flow of forced air between the air supply line 50 and the charge supply line 54. FIGS. 4 and 5 show the tool 10 in an Activated position, wherein the primary and secondary triggers 194 and 198 are depressed, the piston 82 is positioned at a Actuated position within the actuation device body 18, the mechanical force generation and delivery system 12 is in a Deployed position, and the leaf spring(s) 26 are in an Energized state. When tool 10 is in the Activated position, the trigger valve stem 214 is in the position shown in FIG. 8, wherein the upper O-ring 266 allows forced or compressed air to flow between the air supply line 50 and the charge supply line 54.

Referring now to FIGS. 1-8, to mechanically generate and deliver the mechanical driving force, a user depresses the secondary trigger 198 such that the protuberance 314 aligns with the recess 310 in the primary trigger 194 and then subsequently depresses the primary trigger 194. Depression of the primary trigger 194 causes the trigger valve stem 214 to move in the X+ direction until the upper O-ring 266 allows forced or compressed air to flow from the forced air source, through the air supply line 50, through the trigger valve housing 206, through the charge supply line and into the housing 18 of the pneumatic action device 13. Additionally, in this configuration, the lower O-ring 270 forms a seal between the valve stem 214 and the valve housing 206 to prevent the forced or compressed air from exiting the valve housing 206 via the fluted end 240.

The flow of forced or compressed air through the charge supply line 54 and into the housing 18 of the pneumatic action device 13 causes the piston 82 to rapidly move within the housing from Home position toward the Actuated position. The movement of the piston 82 from the Home position toward the Actuated position drives the piston rod 86 in the Y+ direction, whereby the piston rod 86 exerts a force on the fork connector proximal end 94, thereby causing the fork connector distal end 102 to move generally in the X+ direction. Movement of the fork connector distal end 102 in the X+ direction causes the swing fork 118 to rotate about the fork pivot pin 114 in a clockwise direction (relative to the orientation of the tool 10 shown in 2-5). Importantly, as the swing fork 118 rotates about the fork pivot pin 114, a lower one of swing fork engagement arms 126 (i.e., the engagement arm 126 located closest to the leaf spring(s) 26) exerts a force on the lifter pivot 122 causing the lifter housing 108 and the spring lifter pawl 110 to move in the A+ direction. As piston 82 moves toward the Actuated position and the spring lifter pawl 110 moves in the A+ direction the catch tooth 154 of each pawl finger 150 engages the leaf spring distal end(s) 44, thereby pulling the leaf spring distal end(s) 44 in the X+ direction. As should be readily understood by one skilled in the art, movement of the leaf spring distal end(s) 44 in the X+ direction bends the leaf spring(s) 26 about the fulcrum 174 thereby generating mechanical energy stored in the leaf spring(s) 26 and placing the leaf spring(s) 26 in the Energized position.

The mechanical energy generated and stored in the leaf spring(s) 26 is referred to herein as the mechanical driving force. Hence, activation of pneumatic actuation device 13, via flow of forced or compressed air into the actuation device 13, causes the piston 82 to move from the Home position to the Actuated position. This, in turn, via the piston rod 86 and fork connector 30, causes rotation of the swing fork 118 and movement of the spring lifter pawl 110 in the A+ direction, thereby engaging the lifter pawl catch tooth/teeth 154 with the distal end(s) 44 of the leaf spring(s) 26 and bending and energizing the leaf spring(s) 26. Subsequently, as the forced or compressed air flowing into the actuation device 13 causes the piston 82 to move further in the Y+ direction, past the Actuated position, to a Full-Stroke position. As the piston 82 moves past the Actuated position to the Full-stroke position, the spring pawl arms 150 rotate slightly in the clock-wise direction (relative to the orientation of the tool 10 shown in 2-5) by the lifter stop pin 148 such that the spring lifter pawl catch tooth/teeth 154 disengage the leaf spring distal end(s) 44. Upon disengagement of the leaf spring distal end(s) 44, due to the bending of the leaf spring(s) 26 about the fulcrum 174, the leaf spring distal end(s) 44 rapidly and forcefully move in the X− direction and return to the Non-energized position. More specifically, upon disengagement of the leaf spring distal end(s) 44, the mechanical energy stored in the leaf spring(s) 26, i.e., the generated mechanical driving force, is released as the leaf spring distal end(s) 44 rapidly and forcefully returns to the Non-energized position.

As described above, in the exemplary embodiments illustrated in FIGS. 2-5, the leaf spring distal end(s) 44 is/are fixedly connected to driver blade 42. Hence, when the leaf spring(s) are moved to the Energized position, the driver blade 42 is simultaneously moved in the X+ direction. Then, when the mechanical energy stored in the leaf spring(s) 26 is released and the leaf spring distal end(s) 44 rapidly and forcefully move in the X− direction, as described above, the driver blade is also rapidly and forcefully moved in the X− direction, thereby forcefully dispensing, or driving, a fastener, e.g., a brad, nail or staple, (not shown) from the tool magazine 38.

Once the fastener is dispensed, the user can release the primary and secondary triggers 194 and 198, whereby the biasing member 298 returns the primary and secondary triggers 194 and 198 to a non-depressed state, as shown in FIG. 7. When the primary and secondary triggers 194 and 198 are returned to the non-depressed state, the valve spring 218 causes the trigger valve stem 214 to move in the X− direction until the upper O-ring 266 prevents the flow of the forced or compressed air into the trigger valve housing 206, and more particularly, into the housing 18 of the pneumatic action device 13. Additionally, the trigger valve stem 214 moves in the X− direction until the lower O-ring 270 is disposed within the fluted end 240 of the of the center bore 236 such that forced or compressed air trapped within the charge supply line 54 and the pneumatic actuation device 13 is exhausted. Subsequently, the return spring 134 pushes the lifter housing 108 downward in the $A^-$ direction such that the swing fork 118 rotates in the counter-clockwise direction (relative to the orientation of the tool 10 shown in 2-5). The rotation of the swing fork 118, in turn, causes the piston 82 to return to the Home position and the spring lifter pawl catch tooth/teeth 154 to re-engage the leaf spring distal end(s) 44.

The hand tool 10, as described herein, is structured and operable to mechanically generate and deliver a mechanical driving force by utilizing the pneumatic actuation device 13 to actuate the mechanical force generation and delivery system 12, as opposed to utilizing manual force to actuate the mechanical force generation and delivery system 12, as is done with known hand tools. Accordingly, the present hand tool 10 allows a user to apply less manual force (all that is needed is that the user apply manual force to depress the triggers 194 and 198) to actuate a mechanical force delivery system to mechanically generate and deliver the mechanical driving force to dispense/drive the fasteners.

The description herein is merely exemplary in nature and, thus, variations that do not depart from the gist of that which is described are intended to be within the scope of the teachings. Such variations are not to be regarded as a departure from the spirit and scope of the teachings.

What is claimed is:

1. A pneumatically actuated hand tool for mechanically generating and delivering a driving force to a fastener, said hand tool comprising:

a tool housing;

a mechanical force generation and delivery system structured and operable to mechanically generate and deliver a driving force to a fastener; and a pneumatic actuation device pivotally mounted within the tool housing and operatively connected to the mechanical force generation and delivery system, the pneumatic actuation device being structured and operable to actuate the mechanical force generation and delivery system such that the mechanical force generation and delivery system mechanically generates and delivers the driving force, wherein the mechanical force generation and delivery system includes a leaf spring fixedly connected at a proximal end thereof to the tool housing and engaged with a fulcrum about which the leaf spring bends in order to mechanically generate the driving force through a distal end of the leaf spring, the leaf spring storing and releasing energy to drive a driver blade that delivers the driving force to the fastener, wherein the pneumatic actuation device includes an air cylinder including:

a body; and a piston slidably disposed within the body and operatively connected to the mechanical force generation and delivery system via a piston rod, and wherein the fulcrum contacts the leaf spring between the proximal end and the distal end of the leaf spring, closer to the proximal end than to the distal end.

2. The pneumatically actuated hand tool of claim 1, wherein the pneumatic actuation device further includes:

an air inlet formed in a proximal end of the body and fluidly connectable to a forced air source such that air controllably flowing into the body from the forced air source forces the piston from a home position to a full-stroke position to actuate the mechanical force generation and delivery system such that the mechanical force generation and delivery system mechanically generates and delivers the driving force.

3. The pneumatically actuated hand tool of claim 1, wherein the mechanical force generation and delivery system further comprises:

a spring lifter assembly disposed within the tool housing, the spring lifter assembly including a spring lifter pawl disengagably connectable to the distal end of the leaf spring;

a fork connector operatively connecting the pneumatic actuation device to the spring lifter assembly such that actuation of the pneumatic actuation device causes the spring lifter assembly to energize the leaf spring and subsequently release energy from the energized leaf spring, thereby driving the driver blade to dispense the fastener from the tool.

4. The pneumatically actuated hand tool of claim 1 further comprising a trigger assembly including a trigger valve having a valve stem that is structured and operable to control a flow of forced air into the pneumatic actuation device.

5. The pneumatically actuated hand tool of claim 4, wherein the trigger valve comprises an on-off valve.

6. The pneumatically actuated hand tool of claim 4 wherein the trigger assembly comprises a double-pull safety trigger assembly including:

a primary trigger structured and operable to control positioning of the valve stem, the primary trigger comprising a recess formed therein; and a secondary trigger comprising a protuberance that is structured and operable to:

prevent depression of the primary trigger when the secondary trigger is not depressed, and protrude into the recess of the primary trigger when the secondary trigger is depressed, thereby allowing depression of the primary trigger.

7. The pneumatically actuated hand tool of claim 1, wherein the fulcrum is fixedly mounted on an inner surface of the tool housing.

8. A pneumatically actuated hand tool for mechanically generating and delivering a driving force to a fastener, said hand tool comprising:

a tool housing;

a mechanical force generation and delivery system structured and operable to mechanically generate and deliver a driving force to a fastener;

a pneumatic actuation device pivotally mounted within the tool housing and operatively connected to the mechanical force generation and delivery system, the pneumatic actuation device being structured and operable to actuate the mechanical force generation and delivery system such that the mechanical force generation and delivery system mechanically generates and delivers the driving force; and a trigger assembly structured and operable to control a flow of forced air into the pneumatic actuation device, wherein the mechanical force generation and delivery system includes a leaf spring fixedly connected at a proximal end thereof to the tool housing and engaged with a fulcrum about which the leaf spring bends in order to mechanically generate the driving force through a distal end of the leaf spring, the leaf spring storing and releasing energy to drive a driver blade that delivers the driving force to the fastener, wherein the pneumatic actuation device includes an air cylinder including:

a body; and a piston slidably disposed within the body and operatively connected to the mechanical force generation and delivery system via a piston rod, and wherein the fulcrum contacts the leaf spring between the proximal end and the distal end of the leaf spring, closer to the proximal end than to the distal end.

9. The pneumatically actuated hand tool of claim 8, wherein the pneumatic actuation device further includes:

an air inlet formed in a proximal end of the body and fluidly connectable to a forced air source such that air controllably flowing into the body from the forced air source forces the piston from a home position to a full-stroke position to actuate the mechanical force generation and delivery system such that the mechanical force generation and delivery system mechanically generates and delivers the driving force.

10. The pneumatically actuated hand tool of claim 8, wherein the mechanical force generation and delivery system further comprises:

a spring lifter assembly disposed within the tool housing, the spring lifter assembly including a spring lifter pawl disengagably connectable to the distal end of the leaf spring;

a fork connector operatively connecting the pneumatic actuation device to the spring lifter assembly such that actuation of the pneumatic actuation device causes the spring lifter assembly to energize the leaf spring and subsequently release energy from the energized leaf spring, thereby driving the driver blade to dispense the fastener from the tool.

11. The pneumatically actuated hand tool of claim 8, wherein the trigger assembly comprises an on-off trigger valve having a valve stem disposed within a valve housing, the valve stem structured and operable to control a flow of forced air into the pneumatic actuation device.

12. The pneumatically actuated hand tool of claim 11 wherein the trigger assembly comprises a double-pull safety trigger assembly including:

a primary trigger structured and operable to control positioning of the valve stem, the primary trigger comprising a recess formed therein; and a secondary trigger comprising a protuberance that is structured and operable to:

prevent depression of the primary trigger with the secondary trigger is not depressed, and protrude into the recess of the primary trigger when the secondary trigger is depressed, thereby allowing depression of the primary trigger.

* * * * *